US005385681A

United States Patent [19]

Sato et al.

[11] Patent Number: 5,385,681

[45] Date of Patent: Jan. 31, 1995

[54] SCOURING AGENT COMPOSITION FOR FABRIC

[75] Inventors: Toshio Sato, Bangkok, Thailand; Masayuki Abe, Wakayama, Japan; Jureerut Phiu-On, Muang Samutprakarn, Thailand

[73] Assignee: Kao Corporation, Tokyo, Japan

[21] Appl. No.: 91,813

[22] Filed: Jul. 13, 1993

[30] Foreign Application Priority Data

Jul. 29, 1992 [JP] Japan ..... 4-202287

[51] Int. Cl.[6] ..... D06M 1/00

[52] U.S. Cl. ..... 252/8.7; 252/8.6; 252/8.9

[58] Field of Search ..... 252/8.6, 8.7, 8.9

[56] References Cited

U.S. PATENT DOCUMENTS 4,830,764 5/1989 Wiedemann ..... 252/8.6
4,889,945 12/1989 Wiedemann ..... 558/186

FOREIGN PATENT DOCUMENTS 45-7973 3/1970 Japan .
4-108163 4/1992 Japan .

OTHER PUBLICATIONS

Derwent WPI Acc. No. 92-171508/21, English Abstract of JP 4-108163 (1992).
Derwent Xram Acc. No. C70-R21464, English Abstract of JP 70007973 (1970).

*Primary Examiner*—Richard L. Raymond
*Attorney, Agent, or Firm*—Birch, Stewart, Kolasch & Birch

[57] ABSTRACT

A scouring agent composition for a fabric which exhibits high penetrating and scouring powers even under highly alkaline conditions and can produce a scoured fabric excellent in rewettability and which can dissolve in a 11quid medium for current high-speed and automatic desiring, scouring, bleaching and mercerization systems to give a clear cleaning fluid which causes little foaming, comprising (A) an adduct of a secondary or branched alcohol having 8 to 16 carbon atoms with an alkylene oxide, (B) a salt of a secondary alkanesulfonic acid having 13 to 17 carbon atoms and/or a salt of carboxymethylate of an adduct of a branched alcohol having 12 to 18 carbon atoms with an alkylene oxide and (C) a fatty acid having 6 to 18 carbon atoms or a salt thereof.

10 Claims, No Drawings

SCOURING AGENT COMPOSITION FOR FABRIC

BACKGROUND OF THE INVENTION

FIELD OF THE INVENTION

The present invention relates to a scouring agent composition for a fabric and a process for treating a fabric with such a composition. More particularly, the present invention is directed to a particular scouring agent composition for a fabric which is used in a desizing, scouring, bleaching and mercerization system of an unscoured or gray fabric made of a cotton or synthetic fiber, an unscoured blended yarn fabric comprising cotton and synthetic fibers or the like.

DESCRIPTION OF THE PRIOR ART

In the dyeing and processing of a fabric, the desizing, scouring, bleaching and mercerization of an unscoured fabric which has just been woven or knitted up are extremely important steps for the purpose of protecting the fabric from uneven dyeing or physical damages such as wear, abrasion and mar in the subsequent dyeing, finishing and sewing steps.

In order to conduct these important steps smoothly, a system in which the desizing, scouring, bleaching and mercerization can be nearly, continuously conducted is used for a woven fabric. Examples of devices for desizing, scouring and bleaching include a J-Box type scouring machine, a L-Box type scouring machine, a Peable scouring range and a Benteler scouring range. Examples of devices for mercerization include a clip mercerizing machine and a chainless mercerizing machine.

Further, a wince or liquor flow dyeing machine for a batchwise process and a beam dyeing machine or a relaxer for a vertical-flow process are used to conduct the above steps for some woven fabrics and knitted fabrics.

The above devices and machines of the continuous type are remarkably improved in throughput speed as compared with those of the prior art. That is, for example, the throughput speed is about 200 m/min. On the other hand, the above devices and machines of the batch type are improved in the amount of water used. That is, the bath ratio, i.e., the water to cloth ratio is from 5 to 7, which is lower than that of the prior art, which is about 20. Further, they are automated and, for example, the control of a cleaning fluid is currently conducted by providing a by-pass to the device or machine, preparing a calibration curve for the concentration(s) of the active component(s) in the cleaning fluid with respect to electrical conductivity, TOC, absorbance in UV or visible region, refractive index or pH, and checking the concentration(s) of the active component(s) in the cleaning fluid passing through the by-pass based on the calibration curve.

When the cleaning fluid used in the above device or machine exhibits a high foaming power resulting from a penerrant and/or a scouring agent, the turbidity of the cleaning fluid is enhanced by the fine air bubbles dispersed therein, which lowers the accuracy of detection or makes detection impossible, so that the cloth treated in such a wrong state with respect to detection may be insufficiently or unevenly cleaned. As a result, the content of dirt (such as oil) in the cloth being treated is not constant, which brings about unevenness in the coefficient of friction between the cloth and the metal parts of the device or machine holding it which causes mating, abrasion or wear of the cloth due to irregular tension, or unevenness of dyeing in the subsequent step.

A nonionic or anionic surfactant or a mixture thereof has generally been used industrially as a detergent in desizing, scouring, bleaching or mercerization.

In the desizing, scouring, bleaching and mercerization steps of cotton, first, the desizing is generally conducted by the use of a persulfate such as $Na_2S_2O_8$ and $(NH_4)_2S_2O_8$, a bromate such as $Na_2BrO_2$ or hydrogen peroxide ($H_2O_2$) under alkaline conditions, though it is conducted by the use of amylase and a nonionic surfactant in some cases. When the cotton cloth to be treated is thick, the scouring thereof is separately conducted by the use of an alkali solution having a high concentration and a scouring agent, after desizing. On the other hand, when the cotton cloth to be treated has a low density or a small or medium thickness, the desizing and scouring are generally conducted in one step by the use of a scouring agent in the presence of an oxidative desizing agent such as sodium persulfate and a caustic soda having a concentration as high as 15–50 g/l.

Further, in the subsequent bleaching step, hydrogen peroxide, caustic soda and a scouring agent are also simultaneously used in many cases. Although the bleaching is sometimes conducted by the simultaneous use of sodium chlorite and a scouring agent under acidic conditions of about pH 3 in order to inhibit the damage to fabrics due to a bleaching agent, it is required in this case to use a scouring agent which causes little foaming and can be dissolved in the bleaching medium to give a clear liquid.

In the mercerization, furthermore, caustic soda of 25°–30° Be (Baume degree), that is, an aqueous NaOH solution having Na0H concentration of 18.7 to 23.5% by weight, and a penerrant are also used.

Polyester/cotton and polyester/rayon mixed fabrics are used for various clothes including dress shirts, sheets and working clothes. The desizing, scouring and bleaching of these mixed fabrics are conducted in one step by using a scouring agent together with a caustic soda having a concentration as low as 3–10 g/l, hydrogen peroxide, sodium persulfate and a stabilizer in many cases, except in the case where the fabric treated is thick and dense, because the polyester is liable to be hydrolyzed under alkaline conditions.

A synthetic fiber such as a polyester having a high fineness is treated with a spin finish in an amount as large as 0.5 to 3% based on the weight of the fiber in the spinning and knitting steps and with 0.5 to 4%, based on the weight of the fiber, of a sizing agent, mainly comprising an acrylic ester-vinylic acid salt copolymer, in the weaving step to protect the fiber, so that a fabric made of such a fiber is generally desized and scoured by the simultaneous use of a scouring agent having a low foaming power and a caustic soda having a concentration of 0.5 to 5 g/l.

Under these circumstances, the scouring agent for the above fabrics is, as a matter of course, required to have a high penetrating power for cloth, a high detergency and a high persistency thereof to cope with the requirement to shorten the time necessary to conduct the process steps. Furthermore, the scouring agent is required to dissolve in a solution containing caustic soda in a high concentration or in an acidic solution of sodium chlorite to give a clear cleaning solution which causes little foaming. Although the development of a scouring agent satisfying these requirements has been expected, no satisfactory scouring agent has as yet been found.

The nonionic scouring agents according to the prior art include adducts of nonylphenol, octylphenol, synthetic primary alcohols such as Dobanol (a product of Mitsui Petrochemical Industries, Co., Ltd.) and Neodol (a product of Shell), synthetic secondary alcohols such as Softanol (a product of Nippon Shokubai Co., Ltd.) and Tergitol (a product of UCC), and natural higher alcohols such as Kalcol (a product of Kao Corp.) with ethylene oxide; adducts of styrenated phenol and benzylated phenol with ethylene oxide; and adducts of branched alcohols such as 2-ethylhexanol and isotridecyl alcohol with propylene oxide or ethylene oxide, among which adducts of secondary alcohols with ethylene oxide and adducts of branched alcohols with propylene oxide or ethylene oxide are preferable in the penetrating power and detergency exhibited under highly alkaline conditions.

On the other hand, various compounds have been proposed as anionic scouring agents or penerrants. For example, salts of phosphates of alkyl or alkenyl polyethers have recently been disclosed in U.S. Pat. Nos. 4,889,945 and 4,830,764 (Sandoz). However, such a salt is poor in penetrating power and detergency when it is used under highly alkaline conditions in the simultaneous desizing, scouring and bleaching step, in the scouring step or in the bleaching step, so that it cannot be used as a base of a scouring agent, although it exhibits a high penetrating power in the state of an aqueous solution containing it alone. Further, linear-alkylsulfonic acid salts (LAS), alkyl sulfates, salts of alkyl ether sulfates, salts of alkylnaphthalene-sulfonic acids, salts of secondary alkanesulfonic acids and salts of carboxymethylates of adducts of branched alcohols with alkylene oxides have also been proposed as anionic scouring agents or penerrants (see, for example, Japanese Patent Publication-A No. 108163/1992 (published on Apr. 9, 1992; Kao Corp.)), among which, salts of secondary alkanesulfonic acids and salts of carboxymethylates of adducts of branched alcohols with alkylene oxides are excellent in the penetrating power and detergency exhibited under highly alkaline conditions and therefore have been favorably used.

As described above, adducts of secondary alcohols with ethylene oxide, adducts of branched alcohols with propylene oxide or ethylene oxide, salts of secondary alkanesulfonic acids and salts of carboxymethylates of adducts of branched alcohols with alkylene oxides are excellent in the penetrating power and detergency exhibited under highly alkaline conditions. However, they cannot be dissolved in a highly alkaline solution in many cases and cause significant foaming so that they cannot be used as such in the recent desizing, scouring, bleaching and/or mercerization step(s) such as in the high-speed scouring step described above. Even if they can be used, the use thereof is troublesome due to excessive foaming.

Therefore, an antifoaming agent, For example, a mineral oil, polypropylene glycol, dimethylsiloxane oil, a silica gel/silicon mixture and an adduct of reactive silica gel with silicon, is sometimes added to a scouring agent described above. For example, Japanese Patent Publication-B No. 7978/1970 discloses the combination use of an antifoaming agent such as polypropylene glycol or $RCOO(C_2H_4))_1(C_3H_6O)_m(C_2H_4O)_nOCR$ with a scouring agent.

When a scouring agent composition containing such an antifoaming agent is used in an aqueous highly alkaline solution, however, the following troubles occur:

(1) the composition cannot be dissolved in the alkaline solution and makes the solution cloudy, (2) the antifoaming agent and the surfactant contained in the cloudy system are selectively adsorbed on a cloth, so that the surfactant concentration in the system is lowered which results in a lowered detergency and produces a scoured and bleached cloth which is poor in rewettability, and (3) the antifoaming agent is adsorbed on the cloth and thus exhibits little or no antifoaming effect in the practical system.

DISCLOSURE OF THE INVENTION

SUMMARY OF THE INVENTION

The present inventors have extensively tried to solve the above problems and, as a result, have found a scouring agent composition which exhibits excellent penetrating, cleaning and scouring powers under highly alkaline conditions, gives a scoured fabric excellent rewettability and dissolves in mediums used in the current high-speed automatic desizing, scouring, bleaching and mercerization systems to produce a clear cleaning fluid which undergoes little foaming in practical use. The present invention has been accomplished on the basis of this finding.

Namely, the present invention provides a scouring agent composition for a fabric comprising or consisting essentially of (A) an adduct of a secondary or branched alcohol having 8 to 16 carbon atoms with an alkylene oxide, (B) a salt of a secondary alkanesulfonic acid having 13 to 17 carbon atoms and/or a salt of carboxymethylate of an adduct of a branched alcohol having 12 to 18 carbon atoms with an alkylene oxide and (C) a fatty acid having 6 to 18 carbon atoms or a salt thereof.

The scouring agent composition according to the present invention includes a scouring agent for textiles or fibers characterized by comprising (A) an adduct of a secondary or branched alcohol having 8 to 16 carbon atoms with an alkylene oxide, (B) a salt of a secondary alkanesulfonic acid having 13 to 17 carbon atoms and/or a salt of carboxymethylate of an adduct of isotridecyl alcohol with an alkylene oxide and (C) a fatty acid having 6 to 14 carbon atoms or a salt thereof.

Further, the present invention provides a process for scouring a fabric which comprises treating an unscoured fabric with an aqueous solution of the scouring agent composition for a fabric according to the present invention which contains the active components of the scouring agent composition in an amount of 0.01 to 1 wt/v 4, i.e., 0.01 to 1 gm/100ml.

The feature of the present invention lies in the combined use of the above-described components (A) and (B) with component (C) which comprises a relatively short-chain, i.e., 6 to 18 carbon atoms, fatty acid or a salt thereof. According to the present invention, a scouring agent composition which dissolves in an aqueous, highly alkaline solution to give a clear solution which causes little foaming can be provided.

Further scope and the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Among the compounds usable as component (A) according to the present invention, the adduct of a secondary alcohol having 8 to 16 carbon atoms with an alkylene oxide includes those which are commercially available under the trade name of "Softanol" from Nippon Shokubai Co., Ltd. or "Tergitol" from UCC. The secondary alcohol part of the addnet has preferably 11 to 15 carbon atoms and still more preferably 12 to 14 carbon atoms. Although any of the adducts of the secondary alcohol with an alkylene oxide can be used in the present invention, an adduct of the secondary alcohol with ethylene oxide or with propylene oxide and ethylene oxide is preferable and an adduct of the secondary alcohol with 5 to 20 ethylene oxide molecules (average value) is particularly preferable. Further, the adduct of the secondary alcohol with an alkylene oxide has an HLB value ranging desirably from 9 to 15, and still more desirably from 10 to 14.

On the other hand, the adduct of a branched alcohol having 8 to 16 carbon atoms with an alkylene oxide is preferably an adduct of a primary, saturated, branched alcohol having 8 to 16 carbon atoms with an alkylene oxide. The branched alcohol part of the adduct has preferably 11 to 15 carbon atoms and still more preferably 12 to 14 carbon atoms. The adduct of a branched alcohol having 8 to 16 carbon atoms with an alkylene oxide includes an adduct of 2-ethylhexanol with ethylene oxide or with propylene oxide and ethylene oxide, and an adduct of isotridecyl alcohol with ethylene oxide or with propylene oxide and ethylene oxide, among which an adduct of 2-ethylhexanol or isotridecyl alcohol with propylene oxide and ethylene oxide is particularly preferred.

Among the compounds usable as component (B) according to the present invention, examples of the salts of a secondary alkanesulfonic acid having 13 to 17 carbon atoms, preferably 14 to 16 carbon atoms, include "Hostapur SAS" (trade name, a product of Hoechst A. G.), sodium parrafinsulfonate which is commercially available from Nippon Mining, and "Leomin" (trade name, a product of Henkel). The "Hostapur SAS" is represented by the formula:

$$CH_3(CH_2)_n-\underset{\underset{SO_3Na}{|}}{CH}-(CH_2)_mCH_3,$$

wherein m + n = 10–14.

On the other hand, the salt of carboxymethylate of an adduct of a branched alcohol having 12 to 18 carbon atoms with an alkylene oxide as component (B) is preferably an adduct of a primary, saturated, branched alcohol having 12 to 18 carbon atoms with an alkylene oxide, and still more preferably a salt of carboxymethylate of an adduct of isotridecyl alcohol with an alkylene oxide. The alkylene oxide added is preferably 5 to 10 molecules (average value). Further, the salt is preferably a sodium salt. A specific example thereof includes the sodium salt of carboxymethylate of an adduct of isotridecyl alcohol with 5 to 10 ethylene oxide molecules (average value) which is commercially available from Nissan Chemical or Ugine Kuhlmann (France).

The fatty acid having 6 to 18 carbon atoms or a salt thereof to be used as component (C) in the present invention is preferably a saturated one. The number of the carbon atoms is desirably 6 to 14 and still more desirably 8 to 14. Examples of component (C) include straight-chain and branched-chain fatty acids such as 2-ethylhexanoic acid, synthetic nonanoic acid, caproic acid, caprylic acid, capric acid, lauric acid, myristic acid, palmitic acid, stearic acid and mixtures of two or more acids; salts of these acids with sodium, potassium and ammonium; and mixtures of these acids with these salts, that is, salts of these acids, wherein part of the acid remains as such.

In the scouring agent composition of the present invention, the weight ratio of component (A) to component (B) is preferably between 10/90 and 90/10, still more preferably between 20/80 and 80/20, and particularly more preferably between 30/70 and 70/30. Component (C) is present in an amount of, preferably 1 to 20 parts by weight, still more preferably 1 to 10 parts by weight and particularly more preferably 1 to 6 parts by weight based on 100 parts by weight of the total of components (A) and (B).

Needless to say, the scouring agent composition for a fabric according to the present invention can contain other component(s). Examples of such other components include nonionic surfactants such as an adduct of nonylphenol with ethylene oxide and an adduct of styrenated phenol with ethylene oxide; and anionic surfactants such as LAS, alkyl ether phosphates, sodium dialkyl sulfosuccinates, sodium alkylnaphthalenesulfonate and alkyl phosphates. These other components may use together with the scouring agent composition according to the present invention when a cleaning fluid is prepared.

Further, the fluidity or recovery from freezing of a cleaning fluid containing the scouring agent composition according to the present invention can also be improved by the simultaneous use of ethanol, isopropyl alcohol, glycol such as ethylene glycol or propylene glycol, glycerol, Cellosolve or Carbotol.

The scouring agent composition according to the present invention is generally in the form of an aqueous solution containing 20–60% by weight of solutes. However, it may be an aqueous solution having a concentration below this range. Furthermore, it may be in a water-free form, such as in powder or bead form. The scouring agent composition of the aqueous solution type is a clear liquid which causes little foaming.

The process for scouring a fabric according to the present invention comprises treating an unscoured or gray fabric with an aqueous solution containing the scouring agent composition of the present invention, that is, a cleaning fluid, which contains the active components of the scouring agent composition, that is, components (A), (B) and (C), in an amount of 0.0to 1 weight per volume %, i.e., 0.01 to 1 gm/100ml.

The desizing, scouring, bleaching and mercerization steps are conducted in one step or two or more steps. In the practical step(s), the solution to be used in at least one of the .above-described steps contains the scouring agent composition. The concentration of the active components of the scouring agent composition in the solution, that is, the total weight of components (A), (B) and (C) in the solution. is controlled to be within a range of 0.01 to 1 weight per volume %, i.e., 0.01 to 1 gm/100ml, depending upon the extent of staining of the fabric to be treated. The scouring agent composition of the present invention can be dissolved to form a clear solution and the solution causes little foaming.

According to the present invention, a scoured fabric, that is, a woven or knitted fabric or a textile, which does not suffer from unevenness of dyeing, wear or mating in the subsequent dyeing, finishing and sewing steps can be prepared by conducting, according to a continuous or batchwise process, the desizing, scouring, bleaching and mercerization of an unscoured, gray fabric with the scouring agent composition of the present invention.

EXAMPLE

The present invention will now be described in more detail by referring to the following Examples, which should not be considered as limiting the present invention. In the Examples, part(s) is by weight unless otherwise specified.

In the Examples, various properties were evaluated in the desizing, scouring or bleaching step as follows:

<Compatibility>

The compatibility was evaluated depending upon whether an aqueous solution, that is a cleaning fluid, comprising an alkali metal hydroxide and a scouring agent composition and prepared at room temperature was transparent or not.

T: transparent
ST: semitransparent
C : cloudy
S : causing phase separation

<Penetrating power>

A piece (2 cm ×2 cm) of an unscoured fabric was made to float on an aqueous solution of a scouring agent composition, that is a cleaning fluid, to determine the time which had elapsed until the piece sank. The measurement was conducted at 80° C. The penetrating power was determined by averaging the results of five such pieces.

<Foaming>

The desizing and scouring treatment of an unscoured fabric was conducted at 100° C. for 30 minutes with a simple pressure and closed type equipment. When the cleaning fluid reached a temperature of 80° C. after the completion of the desizing and scouring treatment, the equipment was opened and the foaming the surface of the cleaning fluid for the desizing and scouring treatment was evaluated. After removing the cleaning fluid, the scoured fabric was rinsed with warm water at 60° C. with stirring and foaming during rinsing was also evaluated.

H: foaming over the whole surface of the fluid
M: foaming over half of the surface of the fluid
L: foaming over a small part of the surface of the fluid
NF: no foaming

<Rewettability>

3 ml of a 1% aqueous solution of an acid dye (Kayalon Polyester Navy Blue TK-SF 100, Color Index Blue 259) was dropped on a scoured fabric with a syringe to evaluate the rewettability of the fabric. The case wherein a larger spot having a higher roundness was formed was evaluated to be better.

⊙: good
o: medium
Δ: bad
x: not wetted

Example 1(desizing and scouring of cotton fabric in one step)

The desizing and scouring of a plain weave unscoured (or gray) fabric of cotton (broadcloth, No. 40 single yarn, count: 120/inch(warp) 60/inch(weft)) were conducted by the use of various scouring agents and various scouring agent compositions listed in Tables 1 and 2 under the following conditions:

| <recipe> | |
|---|---|
| oxidative desizing agent ($Na_2S_2O_8$ powder) | 5 g/l |
| aqueous caustic soda soln. of 48° Be | 50 g/l |
| scouring agent or composition thereof | 1 g of active component(s)/l |

12 of the fabric in a state of a hollow cylinder was set on a Color-pet machine, Type 12, (mfd. by Nissen K. K.) and desized and scoured at a bath ratio of 1:20 (fabric : solution) at 100° C. for 30 minutes. The penetration time, that is, the time necessary for the desizing and scouring solution, namely the cleaning fluid, to penetrate the unscoured fabric, was evaluated. The compatibility, that is, the solubility of the scouring agent or composition thereof in the cleaning fluid, was evaluated during the preparation of the fluid. Foaming after the desizing and scouring treatment and foaming during rinsing were also evaluated. Further, the rewettability of the scoured fabric was evaluated. The results are given in Tables 1 and 2.

In the Tables, $(EO)_n$ refers to the adduct with ethylene oxide wherein the average number of ethylene oxide molecules added is "n", and $(PO)_m(EO)_n$ refers to the adduct with propylene oxide and ethylene oxide wherein the average number of propylene oxide molecules added is "m" and the average number of ethylene oxide molecules added is "n". When a scouring agent composition is employed, the weight ratio of the components contained is shown in a bracketed passage. The same applies hereinafter.

TABLE 1

| Comp. Product | Scouring agent or composition thereof | Penetration time (sec) | Compatibility | Foaming after cleaning | Foaming during rinsing at 60° C. | Rewettability of scoured fabric |
|---|---|---|---|---|---|---|
| 1 | none | not wetted | — | M | NF | x |
| 2 | sec. alcohol($C_{12\sim14}$) $(EO)_{12}$ | 65 | T | H | M | o |
| 3 | sec. alcohol($C_{11\sim15}$) $(EO)_{8.9}$ | 70 | T | H | M | ⊙ |
| 4 | 2-ethylhexanol $(PO)_{1.0}(EO)_{7.0}$ | 150 | C | M | M | Δ |
| 5 | isotridecyl alcohol $(EO)_{10}$ | 110 | C | H | M | Δ |
| 6 | Na sec. alkane($C_{13\sim17}$)sulfonate*1 | 70 | S | H | M | o |
| 7 | Na carboxymethylate of isotridecyl alcohol $(EO)_7$ (chemical formula:$C_{13}H_{27}O(C_2H_4O)_7CH_2COONa$) | 75 | T | H | H | ⊙ |
| 8 | nonylphenol $(EO)_9$ | 1700 | ST | H | M | o |
| 9 | nonylphenol $(EO)_{13}$ | 2000 or above | T | H | M | o |
| 10 | styrenated phenol $(EO)_{12}$ | 2000 or | C | M | L | Δ |

TABLE 1-continued

| Comp. Product | Scouring agent or composition thereof | Penetration time (sec) | Compatibility | Foaming after cleaning | Foaming during rinsing at 60° C. | Rewettability of scoured fabric |
|---|---|---|---|---|---|---|
| 11 | Na salt of LAS | above 220 | S | H | H | ○ |
| 12 | Na dioctyl sulfosuccinate | 70 | C | H | L | Δ |
| 13 | Na lauryl $(EO)_3$ sesquiphosphate | 170 | T | H | H | Δ |
| 14 | a composition comprising sec. alcohol($C_{12\sim14}$) $(EO)_{12}$ and sodium sec. alkane($C_{13\sim17}$)sulfonate*1 [1:1] | 70 | C | H | M | ○ |

*1: (comp.)
$<C_{13}$ max. 1%
$C_{13\sim15}$ 58%
$C_{16\sim17}$ 39%
$>C_{17}$ max. 1%

TABLE 2

| | Scouring agent or composition thereof | Penetration time (sec) | Compatibility | Foaming after cleaning | Foaming during rinsing at 60° C. | Rewettability of scoured fabric |
|---|---|---|---|---|---|---|
| Comp. Product | | | | | | |
| 15 | a composition comprising sec. alcohol($C_{11\sim15}$) $(EO)_{8.9}$ and Na sec. alkane($C_{13\sim17}$)sulfonate*1 [9:1] | 65 | C | H | M | ◎ |
| 16 | a composition comprising 2-ethylhexanol $(PO)_{1.0}(EO)_{7.0}$ and Na carboxymethylate of isotridecyl alcohol $(EO)_6$ [1:9] | 65 | C | H | H | ◎ |
| 17 | a composition comprising isotridecyl alcohol $(EO)_{10}$ and Na sec. alkane($C_{13\sim17}$)sulfonate*1 [50:50] | 60 | C | H | M | ○ |
| Invention Product | | | | | | |
| 18 | a composition comprising sec. alcohol($C_{12\sim14}$) $(EO)_{12}$, Na sec. alkane($C_{13\sim17}$)sulfonate*1 and coconut oil fatty acid*2 [40:45:15] | 45 | T | L | L | ◎ |
| 19 | a composition comprising sec. alcohol($C_{11\sim15}$) $(EO)_{8.9}$, Na carboxymethylate of isotridecyl alcohol $(EO)_8$ and caproic acid [60:38:2] | 47 | T | L | NF | ◎ |
| 20 | a composition comprising sec. alcohol($C_{11\sim15}$) $(EO)_{8.9}$, Na sec. alkane($C_{13\sim17}$)sulfonate*1 and myristic acid [85:10:5] | 45 | T | L | L | ◎ |
| 21 | a composition comprising sec. alcohol($C_{11\sim15}$) $(EO)_{8.9}$, Na sec. alkane($C_{13\sim17}$)sulfonate*1 and 2-ethylhexanoic acid [10:87:3] | 40 | T | M | NF | ◎ |

*2: Lauric acid CN-48 (a product of Imperial Industrial Chemicals (Thailand) Co., Ltd.)
(comp.)
$C_8$ 3%
$C_{10}$ 6%
$C_{12}$ 48%
$C_{14}$ 20%
$C_{16}$ 9%
$C_{18}$ 3%
oleic acid 9%

As will be understood from the results given in Tables 1 and 2, the cleaning fluids containing the scouring agent compositions of the present invention are excellent in penetrating power, cause little foaming and can give a scoured fabric excellent rewettability. Further, the scouring agent compositions of the present invention are excellent in compatibility.

Example 2 (desizing, scouring and bleaching of polyester/cotton mixed fabric in one step)

The desizing, scouring and bleaching of an unscoured poplin made of 65% of polyester and 35% of cotton having a count of 136/inch (warp)×72/inch (weft) were conducted by the use of various scouring agents and various scouring agent compositions listed in Tables 3 and 4 according to the following recipe under the same conditions as those of Example 1. The penetration time, compatibility, foaming and rewettability were evaluated in the same manner as those of Example 1. The results are given in Tables 3 and 4.

| <recipe> | |
|---|---|
| bleaching agent containing 35% of $H_2O_2$ | 20 g/l |
| aqueous caustic soda soln. of 48° Be | 10 g/l |
| stabilizer containing 50% of $Na_2SiO_3$ | 5 g/l |
| desizing agent ($Na_2S_2O_8$) | 5 g/l |
| scouring agent or composition thereof | 1 g of active component(s)/l |

TABLE 3

| Comp. Product | Scouring agent or composition thereof | Penetration time (sec) | Compatibility | Foaming after cleaning | Foaming during rinsing at 60° C. | Rewettability of scoured fabric |
|---|---|---|---|---|---|---|
| 1 | none | not wetted | — | L | NF | x |

TABLE 3-continued

| Comp. Product | Scouring agent or composition thereof | Penetration time (sec) | Compatibility | Foaming after cleaning | Foaming during rinsing at 60° C. | Rewettability of scoured fabric |
|---|---|---|---|---|---|---|
| 2 | sec. alcohol($C_{12\sim14}$) $(EO)_{12}$ | 40 | T | H | L | ◎ |
| 3 | sec. alcohol($C_{11\sim15}$) $(EO)_{8.9}$ | 45 | T | H | L | ◎ |
| 4 | 2-ethylhexanol $(PO)_{1.0}(EO)_{7.0}$ | 96 | C | L | L | Δ |
| 5 | isotridecyl alcohol $(EO)_{10}$ | 65 | C | L | L | Δ |
| 6 | Na sec. alkane($C_{13\sim17}$)sulfonate*1 | 40 | ST | H | M | ◎ |
| 7 | Na carboxymethylate of isotridecyl alcohol $(EO)_7$ | 42 | T | H | L | ◎ |
| 8 | nonylphenol $(EO)_9$ | 250 | ST | H | L | ∘ |
| 9 | nonylphenol $(EO)_{13}$ | 700 | T | H | L | ∘ |
| 10 | styrenated phenol $(EO)_{12}$ | 1000 or above | C | L | L | Δ |
| 11 | Na salt of LAS | 120 | ST | H | M | ∘ |
| 12 | Na dioctyl sulfosuccinate | 40 | C | H | L | Δ |
| 13 | Na lauryl $(EO)_3$ sesquiphosphate | 140 | T | L | L | Δ |
| 14 | a composition comprising sec. alcohol($C_{12\sim14}$) $(EO)_{12}$ and sodium sec. alkane($C_{13\sim17}$)sulfonate*1 [1:1] | 42 | ST | H | M | ∘ |

TABLE 4

| | Scouring agent or composition thereof | Penetration time (sec) | Compatibility | Foaming after cleaning | Foaming during rinsing at 60° C. | Rewettability of scoured fabric |
|---|---|---|---|---|---|---|
| Comp. Product | | | | | | |
| 15 | a composition comprising sec. alcohol($C_{11\sim15}$) $(EO)_{8.9}$ and Na sec. alkane($C_{13\sim17}$)sulfonate*1 [9:1] | 37 | ST | H | M | ∘ |
| 16 | a composition comprising 2-ethylhexanol $(PO)_{1.0}(EO)_{7.0}$ and Na carboxymethylate of isotridecyl alcohol $(EO)_6$ [1:9] | 37 | ST | H | M | ∘ |
| 17 | a composition comprising isotridecyl alcohol $(EO)_{10}$ and Na sec. alkane($C_{13\sim17}$)sulfonate*1 [50:50] | 35 | ST | H | M | ∘ |
| Invention Product | | | | | | |
| 22 | a composition comprising sec. alcohol($C_{12\sim14}$) $(EO)_{12}$, Na sec. alkane($C_{13\sim17}$)sulfonate*1 and lauric acid [40:45:15] | 25 | T | L | NF | ◎ |
| 19 | a composition comprising sec. alcohol($C_{11\sim15}$) $(EO)_{8.9}$, Na carboxymethylate of isotridecyl alcohol $(EO)_8$ and caproic acid [60:38:2] | 22 | T | L | NF | ◎ |
| 20 | a composition comprising sec. alcohol($C_{11\sim15}$) $(EO)_{8.9}$, Na sec. alkane($C_{13\sim17}$)sulfonate*1 and myristic acid [85:10:5] | 27 | T | L | NF | ◎ |
| 21 | a composition comprising sec. alcohol($C_{11\sim15}$) $(EO)_{8.9}$, Na sec. alkane($C_{13\sim17}$)sulfonate*1 and 2-ethylhexanoic acid [10:87:3] | 23 | T | L | NF | ◎ |

As will be understood from the results given in Tables 3 and 4, the cleaning fluids containing the scouring agent compositions of the present invention are excellent in penetrating power, cause little foaming and can give a scoured fabric excellent rewettability. Further, the scouring agent compositions of the present invention are excellent in compatibility. Therefore, the scouring agent compositions of the present invention can be used in high-speed scouring and facilitate the on-site control of a cleaning fluid.

Example 3 (desizing and scouring of plain cloth made of polyester filaments in one step)

The clearing of an unscoured, gray fabric made of polyester threads having a findress of 150 denier and having a count of 72×72 (warp: 72/inch; weft: 72/inch) which contained 0.5% of a lubricant and about 2% of an acrylic ester-acrylic acid sizing agent adherent thereto was conducted by the use of various scouring agents and various scouring agent compositions listed in Tables 5 and 6 according to the following recipe at 95° C. for 20 minutes. The compatibility, foaming and rewettability were evaluated in the same manner as those of Example 1. Further, the scoured fabric was evaluated with respect to the retention of the sizing agent by the following method. The results are given in Tables 5 and 6.

| <recipe> | |
|---|---|
| alkaline salt (NaOH flakes) | 2 g/l |
| scouring agent or composition thereof | 1 g of active component(s)/l |
| chelate dispersant (Cellesh 700*) | 1 g/l |

*: trade name; a product of Kao; sodium polyacrylate (M.W. = 8,000) and EDTA.

<Evaluation of the retention of the sizing agent>

A stain solution, that is, an aqueous 0.1 weight-/volume % solution of a cationic dye having a pH of about 4 was prepared with Aizen Cathilon Red GLH (color Index Red 38) and acetic acid and sodium acetate for adjusting the pit. A scoured fabric was dipped in the stain solution of 40° C. at a bath ratio of 1/20 (fabric/solution). The temperature of the stain solution was raised to 98° C. and dyeing was conducted at this temperature for 30 minutes. After cooling the stain solution, the fabric was rinsed sufficiently with running water having a temperature of about 50° C. and dried.

The retention of the sizing agent was evaluated on the size of the dyed portion. A larger spot of the dye remained was evaluated to remain the sizing agent a larger quantity.

small: remaining a small quantity
medium: remaining medium
large: remaining a large quantity

TABLE 5

| Comp. Product | Scouring agent or composition thereof | Compatibility | Foaming after cleaning | Foaming during rinsing at 60° C. | Rewettability of scoured fabric | Retention of sizing agent |
|---|---|---|---|---|---|---|
| 1 | none | — | M | NF | x | large |
| 3 | sec. alcohol($C_{11\sim15}$) $(EO)_{8.9}$ | T | H | L | ◎ | medium |
| 4 | 2-ethylhexanol $(PO)_{1.0}(EO)_{7.0}$ | T | H | L | ∘ | large |
| 6 | Na sec. alkane($C_{13\sim17}$)sulfonate*1 | T | H | M | ∘ | medium |
| 7 | Na carboxymethylate of isotridecyl alcohol $(EO)_7$ | T | H | M | ∘ | medium |
| 8 | nonylphenol $(EO)_9$ | T | H | L | ◎ | medium |
| 11 | Na salt of LAS | T | H | M | ◎ | medium |
| 13 | Na lauryl $(EO)_3$ sesquiphosphate | T | L | L | ∘ | large |
| 14 | a composition comprising sec. alcohol($C_{12\sim14}$) $(EO)_{12}$ and sodium sec. alkane($C_{13\sim17}$)sulfonate*1 [1:1] | T | H | M | ∘ | medium |
| 15 | a composition comprising sec. alcohol($C_{11\sim15}$) $(EO)_{8.9}$ and sodium sec. alkane($C_{13\sim17}$)sulfonate*1 [9:1] | T | H | M | ∘ | medium |

TABLE 6

| | Scouring agent or composition thereof | Compatibility | Foaming after cleaning | Foaming during rinsing at 60° C. | Rewettability of scoured fabric | Retention of sizing agent |
|---|---|---|---|---|---|---|
| Comp. Product | | | | | | |
| 16 | a composition comprising 2-ethylhexanol $(PO)_{1.0}(EO)_{7.0}$ and Na carboxymethylate of isotridecyl alcohol $(EO)_6$ [1:9] | T | H | M | ◎ | medium |
| 17 | a composition comprising isotridecyl alcohol $(EO)_{10}$ and Na sec. alkane($C_{13\sim17}$)sulfonate*1 [50:50] | T | H | M | ◎ | medium |
| Invention Product | | | | | | |
| 22 | a composition comprising sec. alcohol($C_{12\sim14}$) $(EO)_{12}$, Na sec. alkane($C_{13\sim17}$)sulfonate*1 and lauric acid [40:45:15] | T | L | L | ◎ | small |
| 19 | a composition comprising sec. alcohol($C_{11\sim15}$) $(EO)_{8.9}$, Na carboxymethylate of isotridecyl alcohol $(EO)_8$ and caproic acid [60:38:2] | T | L | NF | ◎ | small |
| 20 | a composition comprising sec. alcohol($C_{11\sim15}$) $(EO)_{8.9}$, Na sec. alkane($C_{13\sim17}$)sulfonate*1 and myristic acid [85:10:5] | T | M | NF | ◎ | small |
| 21 | a composition comprising sec. alcohol($C_{11\sim15}$) $(EO)_{8.9}$, Na sec. alkane($C_{13\sim17}$)sulfonate*1 and 2-ethylhexanoic acid [10:87:3] | T | L | L | ◎ | small |

As will be understood from the results given in Tables 5 and 6, the scouring agent compositions of the present invention are excellent also in the removal of the acrylic sizing agent.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. A scouring agent composition for a fabric comprising (A) an adduct of a secondary or branched alcohol having 8 to 16 carbon atoms with an alkylene oxide, (B) a salt of a secondary alkanesulfonic acid having 13 to 17 carbon atoms and/or a salt of carboxymethylate of an adduct of a branched alcohol having 12 to 18 carbon atoms with an alkylene oxide anti (C) a fatty acid having 6 to 18 carbon atoms or a salt thereof.

2. The scouring agent composition for a fabric as set forth in claim 1, wherein the weight ratio of component (A) to component (B) is between 10/90 and 90/10 and component (C) is contained in an amount of 1 to 20 parts by weight based on 100 parts by weight of the total of components (A) and (B).

3. The scouring agent composition for a fabric as set forth in claim 1, wherein component (B) is a salt of a secondary alkanesulfonic acid having 14 to 16 carbon atoms.

4. The scouring agent composition for a fabric as set forth in claim 1, wherein component (B) is a salt of carboxymethylate of an adduct of isotridecyl alcohol with an alkylene oxide.

5. The scouring agent composition for a fabric as set forth in claim 1, wherein component (C) is a fatty acid having 6 to 14 carbon atoms or a salt thereof.

6. The scouring agent composition for a fabric as set forth in claim 1, wherein component (C) is a fatty acid having 8 to 14 carbon atoms or a salt thereof.

7. The scouring agent composition for a fabric as set forth in claim 1, wherein the scouring agent composition is in the form an aqueous solution containing 20–60% by weight of solutes.

8. The scouring agent composition for a fabric as set forth in claim 1, wherein the scouring agent composition is in the form of a powder or a bead.

9. The scouring agent composition for a fabric of claim 1 disposed in an aqueous solution, wherein components (A), (B) and (C) are present in an amount of 0.01 to 1 wt/v %.

10. A process for scouring a fabric which comprises treating an unscoured fabric with an aqueous solution of the scouring agent composition for a fabric as set forth in claim 1 which contains the active components of the scouring agent composition in an amount of 0.01 to 1 wt/v %.

* * * * *